US006998783B2

(12) United States Patent
Symons

(10) Patent No.: US 6,998,783 B2
(45) Date of Patent: Feb. 14, 2006

(54) INDUCTIVE OUTPUT TUBE HAVING A BROADBAND IMPEDANCE CIRCUIT

(75) Inventor: Robert Spencer Symons, Los Altos, CA (US)

(73) Assignee: L-3 Communications Corporation, San Carlos, CA (US)

( * ) Notice: Subject to any disclaimer, the term of this patent is extended or adjusted under 35 U.S.C. 154(b) by 120 days.

(21) Appl. No.: 10/378,971

(22) Filed: Mar. 3, 2003

(65) Prior Publication Data

US 2004/0174211 A1 Sep. 9, 2004

(51) Int. Cl.
*H01J 25/02* (2006.01)

(52) U.S. Cl. ..... 315/5.37; 315/5.35; 315/5.51; 315/5.38; 330/45

(58) Field of Classification Search ..... 315/5.37, 315/5.39, 5.51, 5.35, 5.38; 330/44, 45
See application file for complete search history.

(56) References Cited

U.S. PATENT DOCUMENTS 2,391,016 A * 12/1945 Ginzton et al.
2,761,915 A * 9/1956 Pierce
4,583,021 A * 4/1986 Herriott et al. ..... 315/5.37 X
4,931,695 A * 6/1990 Symons ..... 315/5.39
5,572,092 A * 11/1996 Shrader ..... 315/5.37
5,650,751 A * 7/1997 Symons

* cited by examiner

*Primary Examiner*—Benny T. Lee
(74) *Attorney, Agent, or Firm*—O'Melveny & Myers LLP

(57) ABSTRACT

An inductive output tube (IOT) provides improved efficiency and larger bandwidth. In one embodiment, an IOT is provided with an electron gun that generates an electron beam, a tube body, a collector for collecting the electron beam, and an extended-interaction output circuit. The electron beam travels through the tube body and the extended-interaction output circuit. The extended-interaction output circuit is located within the tube body. The extended-interaction output circuit comprises a short-circuited resonant structure. The extended-interaction output circuit is used for reducing undesired components of a radio frequency (RF) wave, increasing desired components of the RF wave, and slowing down the propagation of the RF wave. (That is the circuit increases the integral of the electric field along the path of the beam electrons while decreasing the stored energy associated with those fields.) The extended-interaction output circuit also provides the IOT with larger bandwidth operation. The collector may be a multi-stage depressed collector having voltages on the collector to result in a constant efficiency characteristic. The radio-frequency drive power to the tube is connected by means of a broadband impedance matching transformer, and the grid to cathode capacitance may be reduced by depressions in the surface of the cathode directly underneath the grid structure.

26 Claims, 8 Drawing Sheets

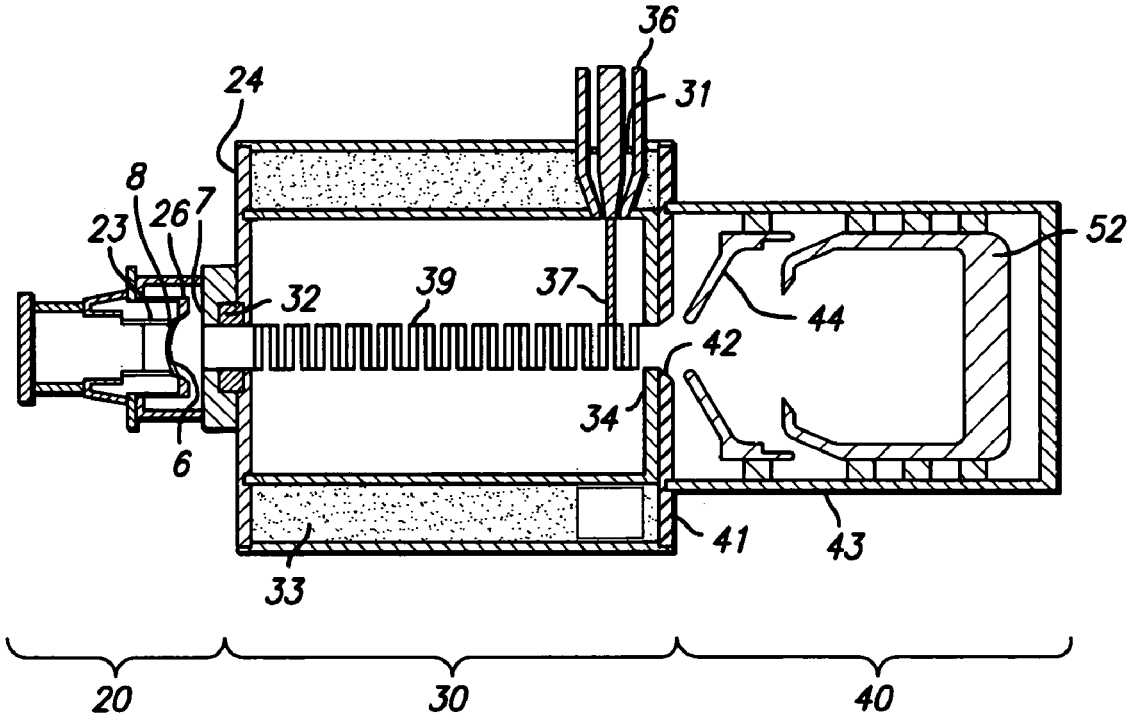
FIG. 1
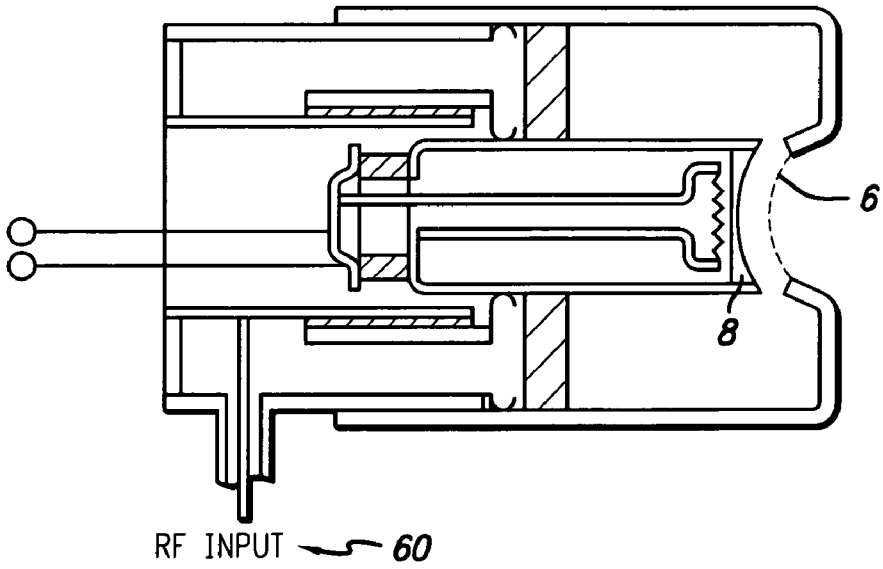

INDUCTIVE OUTPUT TUBE HAVING A BROADBAND IMPEDANCE CIRCUIT

BACKGROUND OF THE INVENTION

1. Field of the Invention

The present invention relates to linear beam devices, such as inductive output tubes, used for amplifying a radio frequency (RF) signal. More particularly, the invention relates to an inductive output tube having an extended-interaction output circuit and/or wide-band input circuit.

2. Description of Related Art

It is well known in the art to utilize a linear beam device, such as a klystron amplifier or traveling wave tube amplifier, to generate or amplify a radio frequency (RF) signal. These amplifiers generally include an electron emitting cathode and an anode spaced therefrom. The anode includes a central aperture; by applying a high voltage potential between the cathode and anode, electrons may be drawn from the cathode surface and directed into a high power electron beam that passes through the anode aperture. The electron beam may be directly modulated in density with a grid in front of a cathode as in an inductive output tube (IOT). Alternatively, the electron beam may be modulated indirectly by modulating the velocity of the electrons and allowing fast electrons to overtake slower electrons as in klystrons or travelling wave tubes. In IOTs and klystrons, the RF energy is removed from the electron beam by allowing the electron beam to pass through a discreet, interaction gap in a resonant cavity and allowing the beam to induce a current that in turn creates an electric field that extracts energy from the beam. In the klystron, the velocity modulation of the electrons is also caused by interaction between electrons in the beam and the electric field in discrete gaps in individual cavities. By contrast, in traveling wave tubes, both the electron bunching and energy extraction are distributed and occur along a transmission line that surrounds the electron beam and propagates an RF wave that travels with nearly the same velocity as the electron beam. This is usually called a "slow wave" because it travels at a velocity less than the velocity of light. The transmission line may be comprised of many cavities, with gaps, that store the energy that passes slowly from cavity to cavity through apertures that couple the cavities, or the wave may travel along one or more helical wires and provide an electric field between turns that interacts with the electrons.

Klystron performance may be enhanced with an extended-interaction output circuit (e.g., a slow wave circuit) to provide for larger bandwidth operation. The design of these extended-interaction amplifiers to provide the desired larger bandwidth of frequencies is often based upon a series of cavities through which an electron beam must travel. Likewise by using short lengths of contra-wound helices in the intermediate and output cavities of a klystron instead of using a discreet gap in each, an extended-interaction klystron may provide greater bandwidth in both the electron-bunching and energy extraction functions. A paper describing an extended-interaction klystron using three cavities was written by M. Chodorow and T. Wessel-Berg, "A High-Efficiency Klystron with Distributed Interaction," IRE Trans. on Electron Devices, pp. 44–55, 1961.

As mentioned briefly above, another type of amplifier, referred to as an inductive output tube (IOT), includes a grid disposed in the inter-electrode region defined between a cathode and an anode. The electron beam may thus be density modulated by applying an RF signal to the grid relative to the cathode or the cathode relative to the grid.

After the anode accelerates the density-modulated electron beam, the electron beam propagates across a gap provided downstream within the IOT and RF fields are thereby induced into a cavity coupled to the gap. The RF fields may then be extracted from the output cavity in the form of an amplified and modulated RF signal.

At the end of its travel through the linear beam device, the electron beam is deposited into a collector or beam dump that effectively dissipates the remaining energy of the spent electron beam. The electrons that exit the drift tube of the linear beam device are captured by the collector and returned to the positive terminal of the cathode voltage source. Much of the remaining energy of the electrons is released in the form of heat when the particles strike a stationary element, such as the walls of the collector. This heat loss constitutes an inefficiency of the linear beam device, and as a result, various methods of improving this efficiency have been proposed.

One such method is to operate the collector at a "depressed" potential relative to the body of the linear beam device. In a typical linear beam device, the body of the device is at ground potential, and the cathode potential is negative with respect to the body. The collector voltage is depressed by applying a potential that is between the cathode potential and ground. By operating the collector at a depressed potential, the opposing or decelerating electric field within the collector slows the moving electrons so that they can be collected at reduced velocities. This method increases the electrical efficiency of the linear beam device as well as reducing undesirable heat generation within the collector.

It is also known for the depressed collector to be provided with a plurality of electrodes arranged in sequential stages in a structure referred to as a multi-stage depressed collector. Electrons exiting the drift tube of the linear beam device actually have varying velocities, and as a result, the electrons have varying energy levels. To accommodate the differing electron energy levels, the respective electrode stages have incrementally increasing negative potentials applied thereto with respect to the linear device body, such that an electrode having the highest negative potential is disposed the farthest distance from the interaction structure. This way, electrons having the highest relative energy level will travel the farthest distance into the collector before being collected on a final one of the depressed collector electrodes. Conversely, electrons having the lowest relative energy level will be collected on a first one of the depressed collector electrodes. By providing a plurality of electrodes of different potential levels, each electron can be collected on a corresponding electrode that most closely approximates the electron's particular energy level. Thus, efficient collection of the electrons can be achieved.

As disclosed in U.S. Pat. No. 5,650,751, a substantial improvement in efficiency of an IOT can be realized by operating the device with a multi-stage depressed collector. When the IOT is configured such that beam current passes through the IOT, during modulation of the RF input signal, both the instantaneous DC current and instantaneous collection voltage (weighted by the individual collector currents and averaged over all collectors and over an RF cycle) would go up and down with the level of the modulated RF output voltage, and both would be proportional to the RF output voltage or the square root of the output power. In other words, the instantaneous modulated DC input power would be proportional to the instantaneous modulated RF output power at all power levels, thereby providing very nearly constant efficiency across the operating range of the device with a proper choice of collector electrode voltages. An IOT having a multi-stage, depressed collector is therefore referred to herein as a constant efficiency amplifier (CEA).

For modern UHF radar, larger bandwidth is needed for frequency agility to avoid jamming (e.g., by enemy or malicious forces). Moreover, in the modern UHF radar system, larger bandwidth is needed to accommodate a frequency chirp together with efficient pulse amplitude modulation because this accommodation allows for pulse compression with minimum time side lobes. Accordingly, it would be desirable to provide an IOT and/or a CEA with larger bandwidth and good efficiency.

SUMMARY OF THE INVENTION

The present invention satisfies the need for an inductive output tube (IOT) to provide larger bandwidth with good efficiency. In one embodiment, an electron gun comprising a cathode, grid (which may be connected to a broadband input circuit) and anode like that of an IOT is provided with an extended-interaction output circuit. The extended-interaction output circuit comprises a slow-wave transmission structure with a length equal to an integral multiple of half-wavelengths (of the slowed wave) and is short-circuited at each end so it is resonant in the center of the desired operating bandwidth. The extended-interaction output circuit having the slow-wave transmission structure is contained within a cavity in the conducting body of the tube. Energy is coupled from the extended-interaction output circuit to an output connector that is part of the tube body. The electron gun generates an electron beam. The electron beam travels through the tube body and the extended-interaction output circuit. The extended-interaction output circuit, which has a wave propagation velocity less than that of the bunches of electrons in the beam, slows the bunches of electrons to provide broad-bandwidth radio frequency (RF) output power. In addition, the IOT having the extended-interaction output circuit (the extended-interaction IOT) may have a multi-stage depressed collector to provide near constant efficiency amplification.

A more complete understanding of the present invention, as well as a realization of additional advantages and objects thereof, will be afforded to those skilled in the art by a consideration of the following detailed description of the embodiment. Reference will be made to the appended sheets of drawings, which first will be described briefly.

BRIEF DESCRIPTION OF THE DRAWING

FIG. 1 is a sectional side view of an exemplary inductive output tube (IOT) having an extended-interaction output circuit;

FIG. 2*a* is a sectional side view that illustrates an input circuit that can be used to couple a radio frequency (RF) signal to an IOT;

DETAILED DESCRIPTION OF THE PREFERRED EMBODIMENT

The present invention satisfies the need for an inductive output tube (IOT) providing larger bandwidth and good efficiency. In one embodiment, an IOT includes a broadband input circuit and an optional extended-interaction output circuit. In another embodiment, an IOT includes a broadband input circuit or an optional extended-interaction output circuit. In the detailed description that follows, like element numerals are used to describe like elements illustrated in one or more of the figures.

Figure 2B:
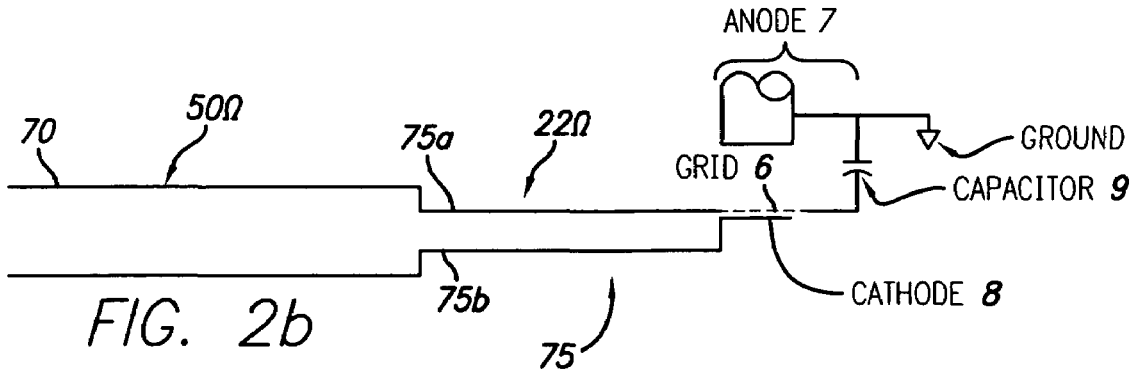
FIG. 2*b* is an equivalent circuit diagram of an input circuit having a broadband transformer.
Figure 2C:
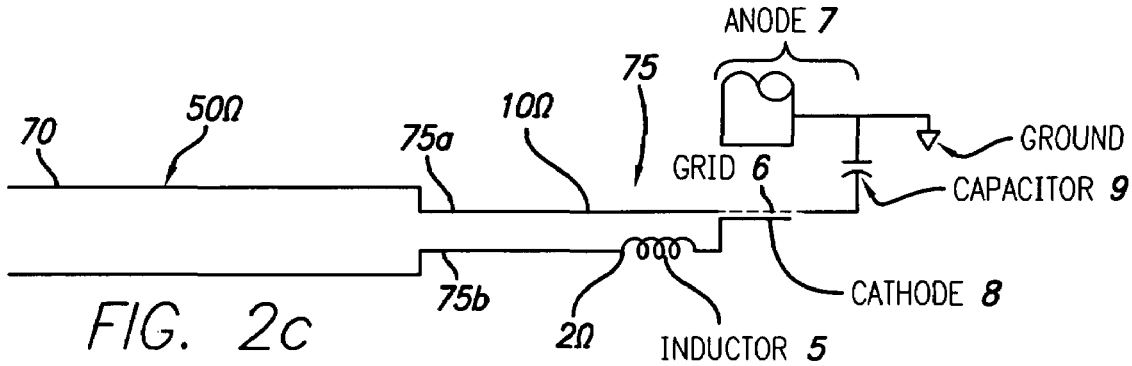
FIG. 2*c* is an equivalent circuit diagram of another input circuit having a broadband transformer.

FIG. 1 illustrates an inductive output tube in accordance with an embodiment of the invention. The inductive output tube includes three major sections, including an electron gun 20, a tube body 30, and a collector 40. The electron gun 20 provides an axially directed electron beam that is density modulated by an RF signal. The electron gun 20 further includes a cathode 8 with a closely spaced control grid 6. The cathode 8 is disposed at the end of a cylindrical capsule 23 that includes an internal heater coil coupled to a heater voltage source. The control grid 6 is positioned closely adjacent to the surface of the cathode 8 and is coupled to a bias voltage source to maintain a direct current (DC) bias voltage relative to the cathode 8. The grid 6 is also capacitively coupled (by means of a capacitor 9 as shown in FIGS. 2*b* and 2*c*) to an anode 7, which is grounded, so that the grid 6 can have no RF potential with respect to ground. The grid 6 comprises a plurality of closely spaced perforations opposing the emitting surface of the cathode 8.

FIG. 2*a* illustrates an input circuit 60 that can be used to couple an RF input signal to the electron gun 20. Referring now only to FIG. 2*a*, an input circuit 60 is disposed adjacent to the control grid 6 such that the RF input signal is coupled to the cathode 8. The input circuit 60 receives the RF input signal that is coupled between the control grid 6 and the cathode 8 to density modulate the electron beam emitted from the cathode 8 (i.e., to control the flow of electrons in correspondence with the RF frequency). Amplifiers with such input circuits are frequently referred to as grounded-grid or cathode-driven amplifiers. Certain embodiments of the present invention do not use a high quality-factor (Q) tuned input circuit, an example of which is provided by U.S. Pat. No. 6,133,786. The '786 patent describes input circuits that employ coaxial resonators utilizing the ¾- or the 1¼-wavelength mode with a voltage point between the grid 6 and the cathode 8. The impedance at this voltage point is calculated by dividing the square of the peak voltage between the grid 6 and the cathode 8 by twice the drive power. For example, a 30 kW digital television IOT having a peak voltage between the grid 6 and the cathode 8 of about 100 volts and a drive power of about 500 watts would have an impedance at this voltage point of about 10 ohms. Other voltage maxima in coaxial resonators have much higher voltages. The higher voltages result in more energy stored in the electric fields of these resonators as compared with the energy stored near the grid-cathode gap. Accordingly, since the quality factor, Q, of a resonant circuit is proportional to the energy stored divided by the energy lost per cycle and, as shown below, the RF bandwidth Δf is inversely proportional to the Q of the resonant circuit, through $$\frac{\Delta f}{f_o} = \frac{1}{Q}$$

wherein $f_o$ is the center or resonant frequency of oscillation within the shorted resonant circuit, the present inventive entity discovered that, by eliminating the extra one-half or one wavelength and operating in the ¼-wavelength mode (i.e., with a short circuit closer to the grid-cathode gap), the operating bandwidth of the input circuit would increase. Unfortunately the short circuit for the quarter-wavelength mode is usually inside the electron gun structure of the IOT.

In one embodiment of the present invention, the cathode 8 is driven with an input circuit having a broadband impedance transformer. The transformer matches a characteristic impedance of an RF driver transmission line of 50 ohms with a cathode impedance of approximately 10 ohms. Referring to FIGS. 2*b*–2*e*, an example of a transformer 75 of the present invention would be a quarter-wavelength section of coaxial line (having an outer conductor 75*a* connected with the grid 6 and an inner conductor 75*b* connected with the cathode 8) with an impedance that is the geometric mean of the drive transmission line 70 (e.g., at 50 ohms) and the cathode impedance (e.g., at 10 ohms). It should be appreciated that the grid 6 is at signal potential, and the cathode 8 is at a high negative potential relative to the anode, as is generally understood in the art. The terms "outer"and "inner"refer to their physical relationship to the electrode gun. Accordingly, the "outer conductor"is coupled to the grid 6, which is physically disposed outwardly of the electron gun, and the "inner conductor"is coupled to the cathode 8, which is physically disposed inwardly of the grid from the perspective of the electron gun.

Figure 2D:
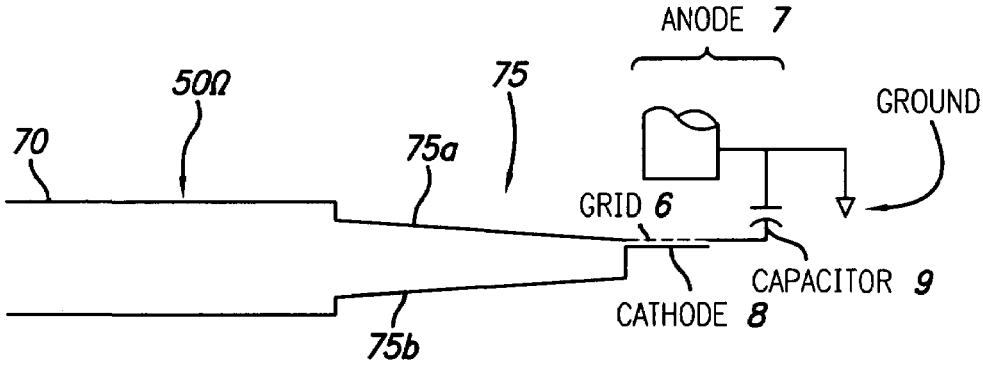
FIG. 2*d* is an equivalent circuit diagram of another input circuit having a broadband transformer.
Figure 2E:
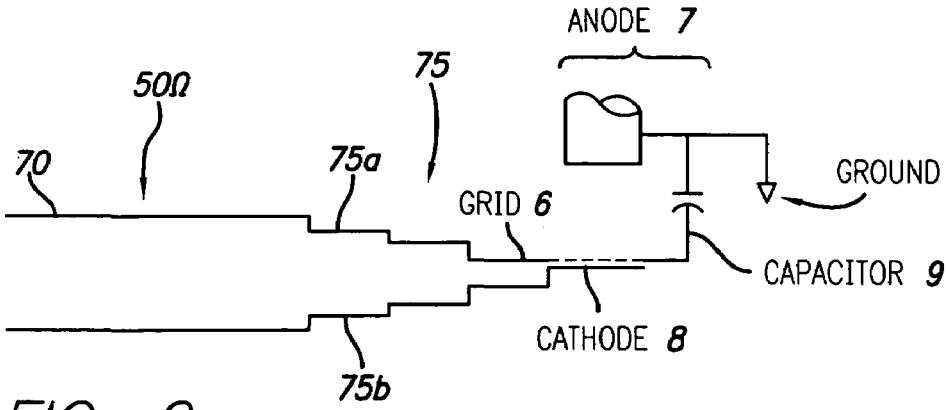
FIG. 2*e* is an equivalent circuit diagram of another input circuit having a broadband transformer.
Figure 11:
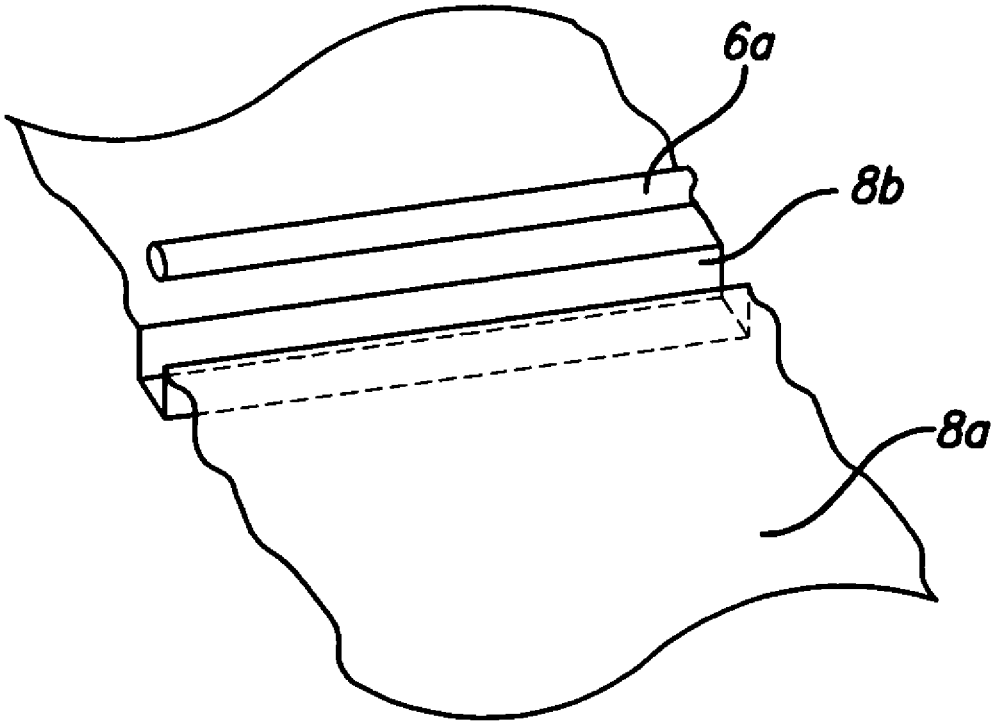
FIG. 11 is a partial sectional view of an exemplary cathode having a groove formed in a surface thereof and a grid wire aligned with the groove.

Referring still to FIG. 2*b*, if there were no grid to cathode capacitance, the impedance of the transformer 75 would be about 22 ohms. In actuality and referring to FIG. 2*c*, there is appreciable capacitance between the grid 6 and the cathode 8, and it is necessary to resonate this capacitance with a very short section of transmission line such that the impedance of the capacitance and the series inductive section of line (represented by the inductor 5 in FIG. 2*c*) combined is about 2 ohms. The short length, section of the transmission line has a higher characteristic impedance than that of the gap between grid 6 and cathode 8 so that the short length section acts as a series inductance that cancels a shunt capacitance of the gap. Thus, in one embodiment of the present invention, a 10 ohm characteristic impedance quarter-wavelength transformer 75 will be used to match the 2 ohm cavity impedance to the 50 ohm RF driver impedance. Other suitable transformers comprising tapered lines as shown in FIG. 2*d* (e.g., a long, tapered section of coaxial line) or multiple ¼-wavelength steps as shown in FIG. 2*e* (e.g., a binomial transformer) can also be used to provide a transmission line of gradually changing characteristic impedances. The input circuit could also comprise high-voltage isolating choke joints or chokes to allow conductor (s) of the input circuit 60 (see FIG. 2*a*) to be at DC ground potential. Because the capacitance between the cathode 8 and the grid 6 is mostly contributed by the close space between the grid (the grid wire) 6 and the cathode 8 directly under the grid 6, in another embodiment of the invention the magnitude of the series inductive section is (and can be) reduced by placing a plurality of grooves 8*b* (or depressions) in the surface of the cathode 8*a* directly under some conductors 6*a* of the grid 6, as shown in FIG. 11. For the parameters used in this embodiment, this would make the characteristic impedance of the matching section 75 rise from 10 ohms toward the 22 ohm level shown in FIG. 2*b*.

Accordingly, based on the foregoing, a preferred embodiment of the present invention comprises an input circuit having a quarter-wavelength section of coaxial line with an impedance that is the geometric mean between the two impedances to be matched. For example, in order to match a 2 to 10 ohm load (the grid-cathode gap) to a 50 ohm transmission line from the drive amplifier, the geometric mean would be between about 10 and about 22.36 ohms (i.e., the square root of 100 to 500). This preferred embodiment not only provides a wide-band input circuit for an IOT, it also results in simpler hardware for the input of many narrow-band amplifiers because the gears, screws, actuators and contact finger stock used with tuning plungers of narrow-band cavities (as exemplified by the high –Q tuned input circuit in U.S. Pat. No. 6,133,786) are eliminated. The gears, screws, actuators and contact finger stock can be eliminated in certain embodiments of the present invention because the wide-band input circuit used in these embodiments can provide the needed RF frequencies without tuning.

Referring now back to FIG. 1, the control grid 6 is physically held in place by a grid support 26. An example of a grid support structure for an inductive output tube is provided in U.S. Pat. No. 5,990,622. An inner surface of the grid support 26 provides a focusing electrode used to shape the electron beam as it exits the cathode 8 and control grid 6.

Figure 3:
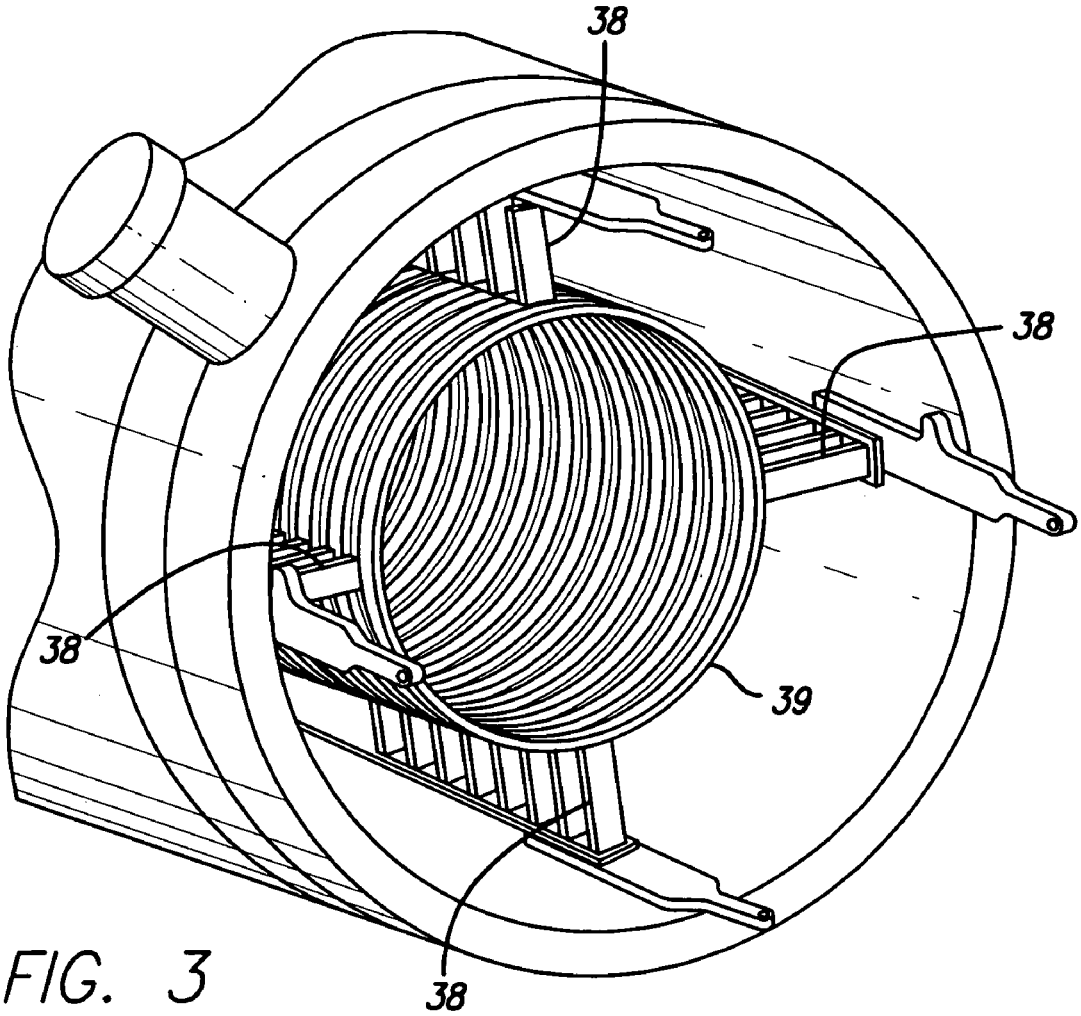
FIG. 3 is a perspective view of an extended-interaction output circuit supported on ceramic rods.

The modulated electron beam passes through the tube body 30, which further comprises a first drift tube portion 32, an extended-interaction output circuit 39, and a second drift tube portion 34. The first and second drift tube portions 32 and 34 and the extended-interaction output circuit 39 each have an axial beam tunnel extending therethrough. The first and second drift tube portions 32 and 34 are connected with each other by the extended-interaction output circuit 39. The circuit 39 also comprises a slow-wave structure that is housed within or covered by the tube body 30. In one embodiment of the present invention, referring to FIG. 3, an extended-interaction output circuit 39 is supported within a tube body on ceramic rods 38.

Output power from the slow-wave circuit 39 (i.e., the circuit having the slow-wave structure) is taken from the slow-wave circuit 39 via the metallic conductor 37 that connects a point on the slow-wave circuit 39 to a coaxial transmission line or a ridged or other low impedance waveguide 36 comprising an RF transmitting window 31 and which passes through the conducting body of the IOT. The IOT is further incorporated with a magnetic solenoid 33 that generates a magnetic flux. The magnetic flux serves to guide the electron beam as it passes through the axial beam tunnel. An example of a magnetic solenoid for an inductive output tube is provided in U.S. Pat. Publication No. US2002-0180362 A1, now issued as U.S. Pat. No. 6,617,791.

Referring still to FIG. 1, the leading edge of the first drift tube portion 32 is spaced from the grid support 26 and provides the anode 7 for the electron gun 20. The first drift tube portion 32 is held in an axial position relative to the cathode 8 and the grid 6 by a first polepiece 24. The extended-interaction output circuit 39 is spaced between the first and second drift tube portions 32 and 34. This circuit 39 is used to slow down the propagation of RF wave within the tube body 30 in order to insure optimum energy exchange or interaction between the electron beam and the RF field. In this embodiment, the electric fields of the circuit 39 are short-circuited at each end of the circuit 39 so the energy on the circuit 39 passes back and forth in a forward wave and a reflected wave. Only part of the forward wave is removed by the metallic output connection on each transit. In addition, the reflected wave, when reflected from the first drift tube portion 32, provides intense fields all along the circuit 39 that travel with the electrons of the beam and efficiently remove their energy (i.e., the energy associated with the electrons). As will be further described below, the present extended-interaction output circuit 39 also has other objects, functions, features, and advantages within the IOT, such as reducing the undesired Fourier components of the RF wave.

The collector 40 comprises an outer housing 43. The outer housing 43 has an axial opening to permit electrons of the spent electron beam to pass therethrough and be collected after having traversed the drift tube 30. The outer housing 43 may comprise a series of electrodes. An end of the second drift tube portion 34 coupled to the second polepiece 41 provides a first collector electrode 42. The first collector electrode 42 has a surface that tapers outwardly from the axial beam tunnel to define an interior wall of a collector cavity. The collector 40 further includes a second electrode 44, a third electrode 52, etc. The second and third electrodes 44 and 52 each have an annular-shaped main body with an inwardly protruding electron-collecting surface. The fifth electrode 52 also serves as a terminus for the collector cavity and may include an axially centered spike (not shown). The electrodes may further include grooved surfaces as described in U.S. Pat. No. 6,462,474. The shapes of the electrodes may be selected to define a particular electric field pattern within the collector cavity. Moreover, it should be appreciated that a greater (or lesser) number of collector electrodes could be advantageously utilized and that the five-electrode embodiment described herein is merely exemplary. The electrodes are generally comprised of an electrically and thermally conductive material, such as copper coated with graphite or another form of carbon.

Each of the collector electrodes has a corresponding voltage applied thereto. In the embodiment shown, the second drift tube portion 34 is at a tube body voltage, such as ground, and the first collector electrode 42 is therefore at the same voltage. The other electrodes have other voltage values applied thereto ranging between ground and the cathode voltage. To prevent arcing between adjacent ones of the electrodes, insulating elements are disposed therebetween. The collector electrodes and insulators may be further contained within a pair of sleeves that provide a path for a flow of oil coolant. An example, of an inductive output tube having an oil-cooled, multi-stage depressed collector is provided in U.S. Pat. No. 6,429,589.

Figure 4:
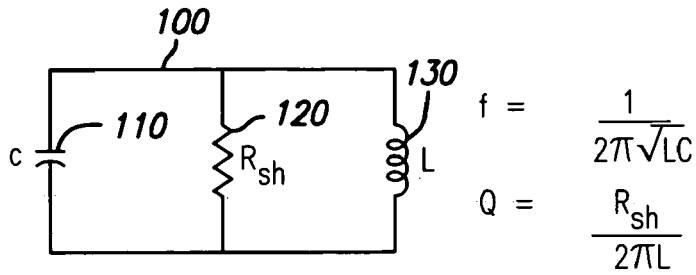
FIG. 4 PRIOR ART
FIG. 4 is a conventional lumped circuit model representing an output circuit that can be used in an IOT with a discrete interaction gap.

In the context of the present invention, certain conditions were derived for creating a desired output circuit 39 for an IOT. For example, the output circuit 39 should comprise a resonant structure with sufficient impedance-bandwidth product to provide efficient energy extraction from the electron beam over the required frequency range. A conventional discrete-interaction-resonant circuit is represented by circuit model 100 shown in FIG. 4. Referring now to FIG. 4, circuit model 100 comprises a circuit capacitance C 110 (representing the interaction gap capacitance), a shunt resistance $R_{sh}$120 (representing the useful load for the output power), and a circuit inductance L 130 (representing the volume of the cavity) that are connected in parallel. The fractional bandwidth for a resonant circuit is equal to the product of the ratio of shunt resistance $R_{sh}$ to quality factor Q, an invariant of any resonator, and the value of $R_{sh}$. For circuit model 100, the ratio of shunt resistance $R_{sh}$ to quality factor Q can be defined as L/C, $2\pi fL$, or $1/2\pi fC$, all of which are equal at resonance. It can also be expressed as the square of the peak RF voltage with which an electron can interact (for circuit 100, the voltage across the parallel components) divided by $2\omega U$, in which $\omega=2\pi f$ and U is the peak energy stored in either the electric or magnetic field for that value of RF voltage.

For IOTs using cavity resonators, this last definition is most appropriate because the peak RF voltage can be defined as the integral of the electric field along the path of an electron through a gap. In the context of the present invention, the last definition is again useful because it can also define the voltage as the integral of the electric field along the path of the electron through the slow-wave circuit (e.g., circuit 39) and define the stored energy as the energy in the electric or magnetic fields in the vicinity of the circuit (e.g., circuit 39). This energy is being reflected back and forth between the short circuits at each end. As shown before, Q is inversely proportional to the bandwidth $\Delta f$ that can be covered by the shorted resonant circuit. Thus, to achieve large bandwidth for the shorted resonant circuit, the value of Q should be small.

In addition, since $R_{sh}$ is proportional to Q, through the equation:

$$Q = \frac{R_{sh}}{2\Pi fL}$$

wherein L is the inductance (e.g., 130 in FIG. 2), the ratio of $R_{sh}$ to quality factor Q is proportional to the bandwidth $\Delta f$ at a given frequency f, which is determined by the equation:

$$f = \frac{1}{2\Pi\sqrt{LC}}$$

Thus, generally, to achieve the desired large bandwidth, the value for the $R_{sh}/Q$ of the shorted resonant circuit should be large. In a preferred embodiment of the invention, the ratio of $R_{sh}/Q$ of the shorted resonant circuit is greater than 200.

Figure 5:
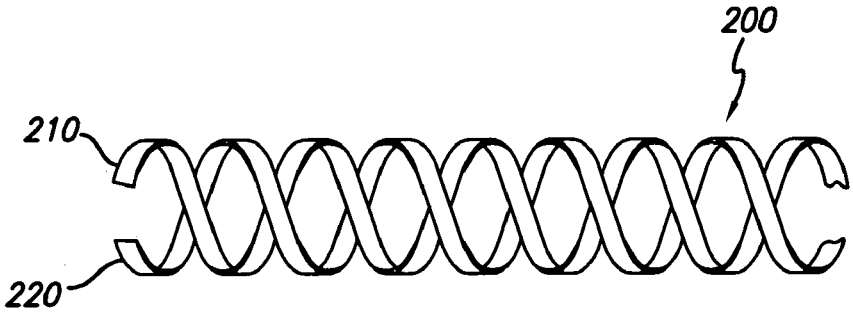
FIG. 5 is an embodiment of a contra-wound coil that can be used in an extended-interaction output circuit within an IOT.

FIG. 5 illustrates an embodiment of a slow wave structure that may be incorporated within an extended-interaction output circuit of the present invention (e.g., the slow wave structure for the extended-interaction output circuit 39 shown in FIG. 1). In this embodiment, the extended-interaction output circuit comprises a slow wave circuit that is short-circuited. The slow wave circuit comprises a contra-wound coil 200. The contra-wound coil 200 has a clockwise coil 210 that is contra-wound with a counter-clockwise coil 220. The two contra-wound coils 210 and 220 (by increasing an axial electrical field) reduce the undesired Fourier components of the RF frequency wave on the circuit 39 to a small value and increase the useful beam interaction components of the RF wave on the circuit 39.

Figure 6:
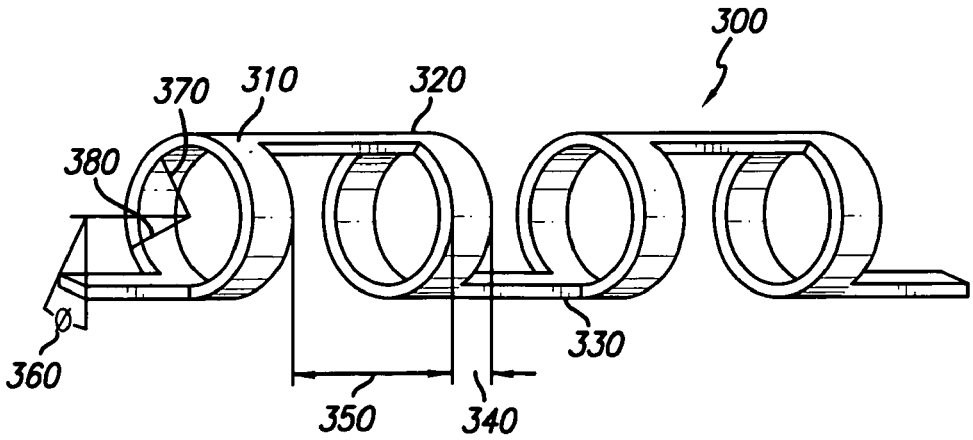
FIG. 6 is an embodiment of a ring-bar structure that can be used in an extended-interaction output circuit within an IOT.

FIG. 6 illustrates another embodiment of a slow wave structure that may be incorporated within an extended-interaction output circuit (e.g., circuit 39 shown in FIG. 1). In this embodiment, the extended-interaction output circuit comprises a ring-bar structure 300. Basically, the ring-bar structure 300 is derived from the contra-wound coil 200 shown in FIG. 3 and is also short-circuited. Referring still to FIG. 6, the ring-bar structure comprises a series of axially aligned parallel rings 310. The rings are joined by alternating bars 320 or 330. Each of the bars 320 or 330 has a bar length 350 and a pitch angle Φ 360. Each of the rings 310 has an inner radius 370, an outer radius 380, and a ring length 340. The optimum bar length 350, ring length 340, pitch angle Φ 360, inner radius 370 and/or outer radius 380 can be selected based on the above desired $R_{sh}/Q$ values (which, for example, are determined by the velocity of the electron beam, the electric field pattern within the shorted resonant circuit, and/or the frequency of the RF wave). In one embodiment, the inner radius 370 is about three-eighths of an inch for producing the desired and optimum RF bandwidth (or range). More particularly, the beam tunnel in a preferred embodiment has a inner radius 370 equivalent to one-half to one and one-half radian of transit angle at an operating frequency for an electron traveling at a velocity corresponding to a voltage of the density modulated beam.

It should also be appreciated that other slow wave structures and extended-interaction output circuit shapes known to those skilled in the art could be advantageously utilized and that the contra-wound coil and the ring-bar circuit embodiments described herein are merely exemplary. Furthermore, referring now back to FIG. 1, the efficiency of the circuit (e.g., circuit 39) for the IOT can be enhanced by tapering the pitch of the contra-wound helices or ring-bar circuit extending through the circuit.

In addition, for the case of the contra-wound coil and/or the ring-bar shorted resonant circuit embodiments described above, $R_{sh}/Q$ is also proportional to the Pierce interaction impedance K and the length of the circuit, through the equation:

$$\frac{R_{sh}}{Q} = \frac{n\Pi K v_g}{v}$$

wherein n is the length of the circuit in half-wavelengths, $v_g$ is the group velocity, and v is the phase or electron velocity. The Pierce impedance K has been defined in a paper written by J. R. Pierce, "Traveling-Wave Tubes," D. Van Nostrand Book Co., Inc. New York, N.Y., 1950. Thus, generally to achieve the larger $R_{sh}/Q$ (i.e., the desired larger bandwidth), the length n of the circuit 39 (e.g., bar length 350 and ring length 340) should be long and the value of the Pierce impedance should be high. In the context of the present invention, it was discovered that a 25 KV ring-bar circuit can have a Pierce impedance of 100 ohms per radian. Accordingly, in one embodiment of the present invention, the extended-interaction output circuit can have an $R_{sh}/Q$ value of 600 or more and produce a bandwidth of approximately 50 MHz or more with a shunt resistance of 5000 ohms and a center frequency near 500 MHz.

Referring back to FIG. 1, since the anode 7 of the IOT has a hole in the middle and in front of the cathode 8, the electric field from the anode 7 is strongest at the edge of the grid 6. This electric field extends through a plurality of perforations on the grid 6 and draws out current from the cathode 8. In the middle of the grid 6, electron current is essentially cut-off since the electric field at the center of the cathode 8 is negative. If there is a negative voltage on the grid 6 at the outside edge, the negative field from the grid 6 is overcome by the positive field from the anode 7 which is poking through the perforations of the grid 6. As a result, a lot of current is drawn at the edge of the grid 6 resulting in a hollow beam. To address this problem, it is desirable to make the grid cut-off field substantially uniform across the surface of the grid 6, or even highest at the outer edge of the grid 6. This is achieved by increasing the size of perforations at the center of the grid 6 and decreasing the size of perforations at the edge of the grid 6.

Figure 7:
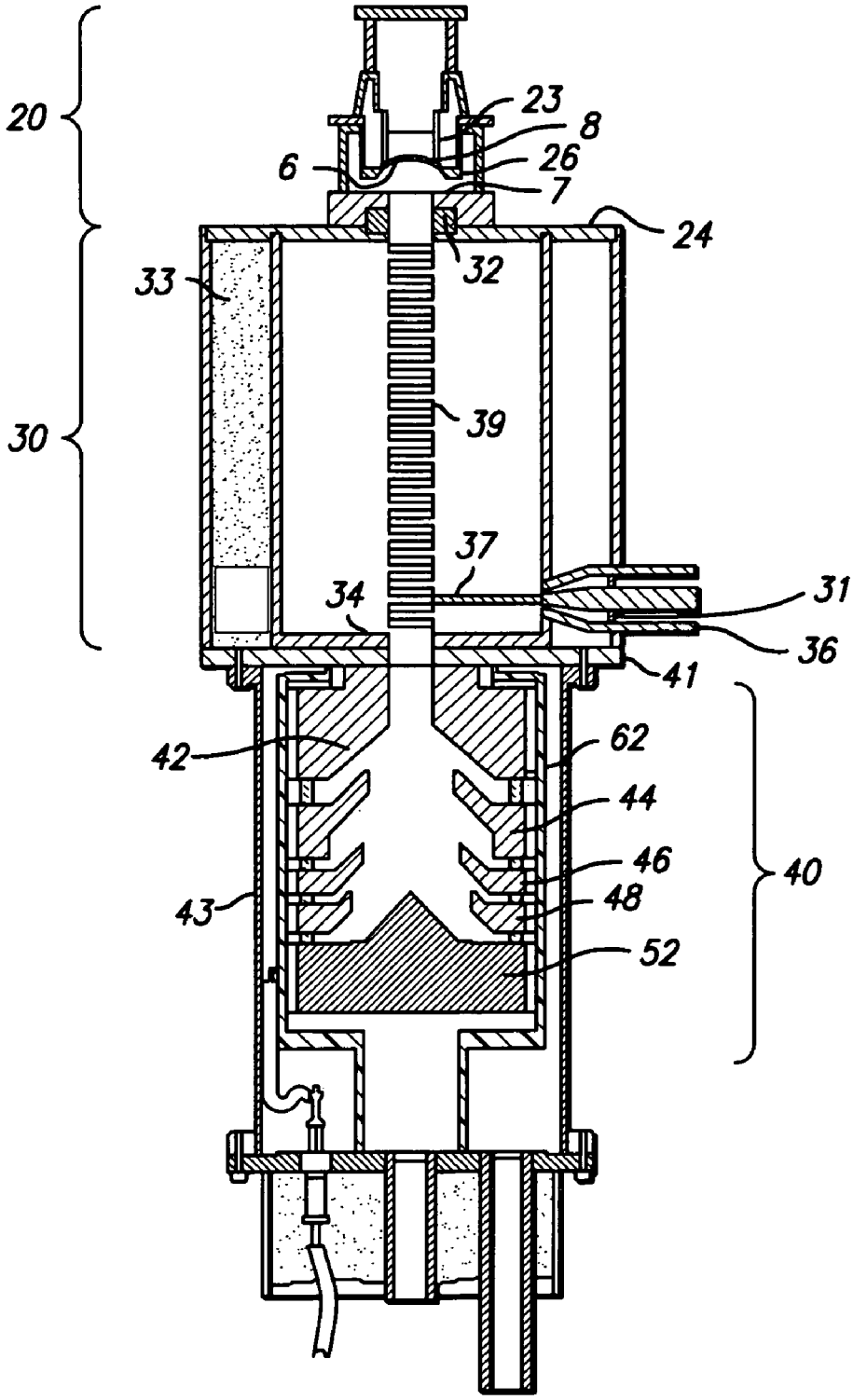
FIG. 7 is a sectional side view of another exemplary IOT having an extended-interaction output circuit.

FIG. 7 illustrates another embodiment of an inductive output tube in accordance with the invention, in which all elements having like reference numerals in FIG. 1 are as described above. Similar to the embodiment shown in FIG. 1, the output tube of FIG. 7 includes an electron gun 20 section, a tube body 30 section, and a collector 40 section. In this embodiment, however, the collector comprises an inner structure 62 and an outer housing 43. The inner structure 62 has an axial opening to permit electrons of the spent electron beam to pass therethrough and be collected after having traversed the drift tube 30. The inner structure 62 may comprise a series of electrodes. Furthermore, the third electrode 52 includes an axially centered spike and the collector 40 further includes a fourth electrode 46 and a fifth electrode 48. In addition, the tube body 30 comprises a first polepiece 24, an extended-interaction output circuit 39, and a second polepiece 41. The first and second polepieces 24 and 41 and the extended-interaction output circuit 39 each have an axial beam tunnel extending therethrough. The first and second polepieces 24 and 41 are connected with each other by the extended-interaction output circuit 39. The leading edge of the first polepiece 24 is spaced from the grid support 26 and provides an anode 7 for the electron gun 20. The second polepiece 41 provides the first collector electrode 42 for the collector 40. In this embodiment, the extended-interaction output circuit 39 is shown to include a structure similar to the ring-bar structure 300 shown in FIG. 6. It should be appreciated that other structures, such as the contra-wound coil 200 shown in FIG. 5, can also be used.

Figure 8:
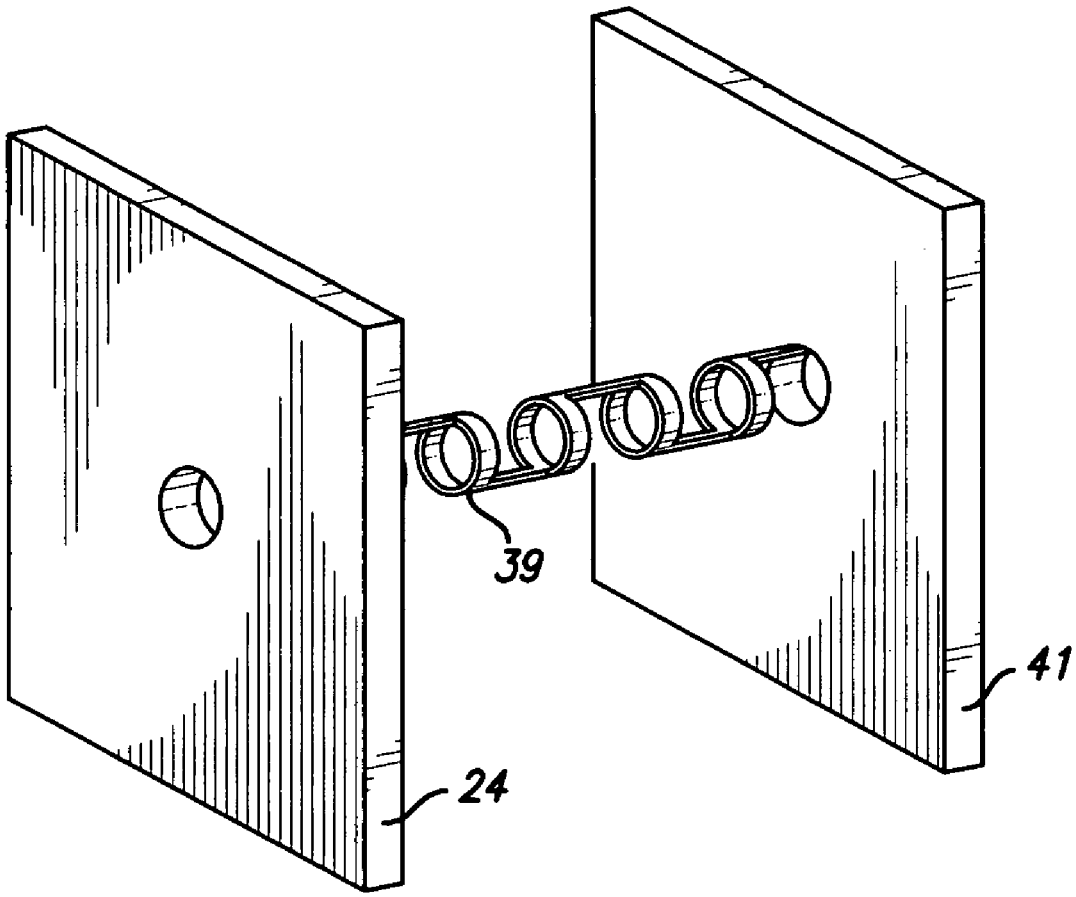
FIG. 8 is a perspective view of an exemplary extended-interaction output circuit that can be used with an IOT.
Figure 9:
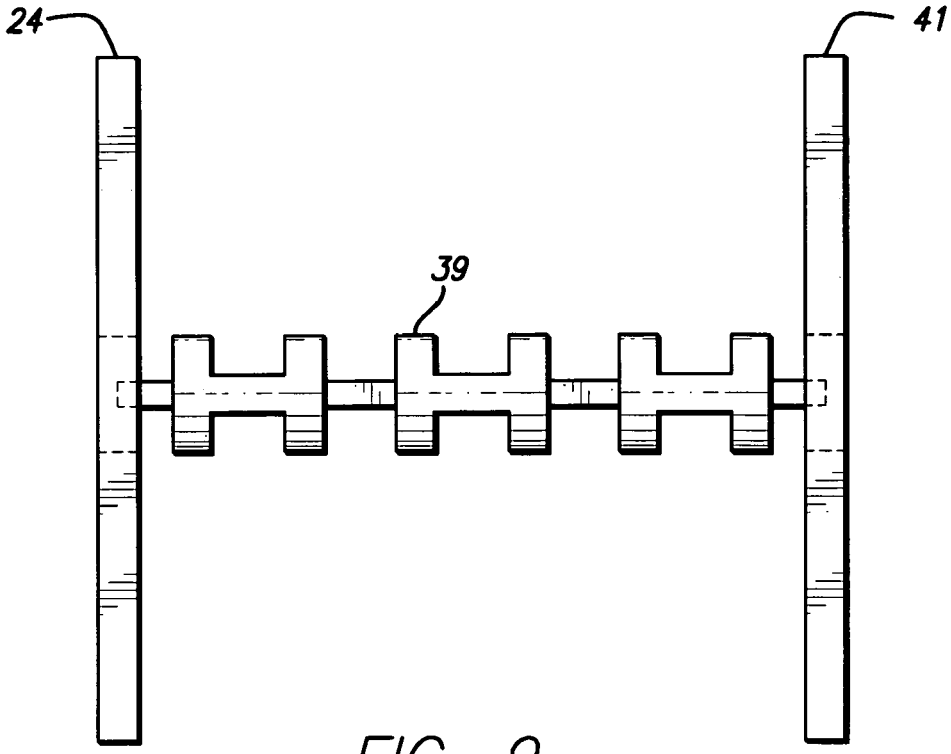
FIG. 9 is a bottom view of the extended-interaction output circuit of FIG. 6.
Figure 10:
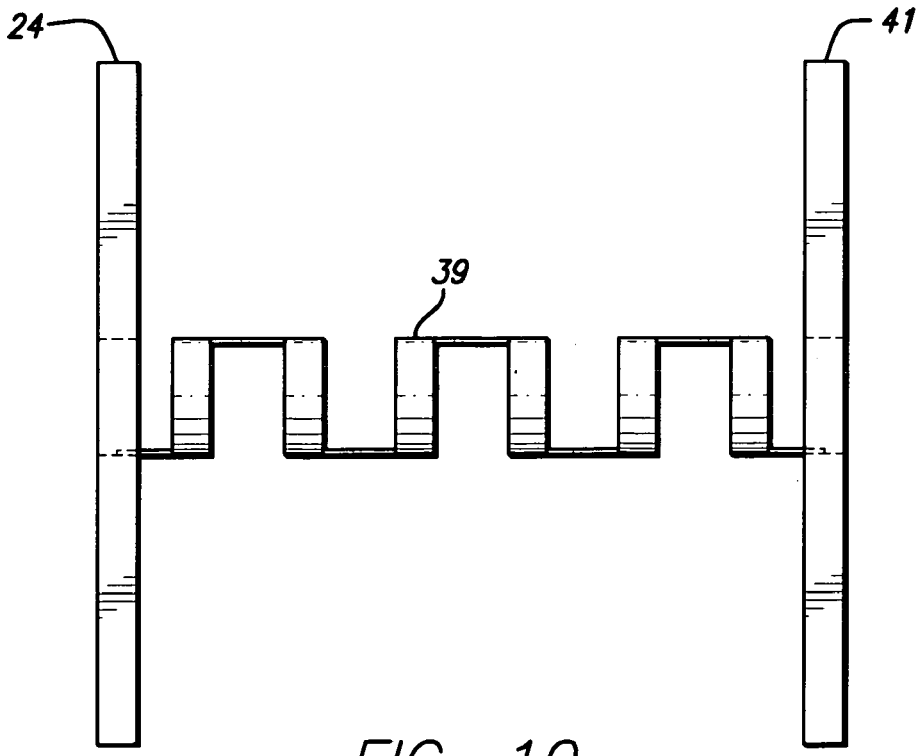
FIG. 10 is a side view of the extended-interaction output circuit of FIG. 6.

FIGS. 8–10 illustrate in greater detail another embodiment of an extended-interaction output circuit 39 associated with an inductive output tube of the present invention. In this embodiment, the extended-interaction output circuit 39 is connected to a first polepiece 24 and a second polepiece 41. The first and second polepieces 24, 41 and the output circuit 39 can be combined with other elements of the inductive output tube as shown in FIGS. 1 and/or 7. In one embodiment, the output circuit 39 comprises a ring-and-bar structure that is connected to the first and second polepieces 24, 41 at the mid-point of a bar (e.g., bar 320 or 330 in FIG. 6 that is joined to a ring) of the ring and bar structure. This is because in this embodiment the output circuit is being utilized as a resonating structure inside the inductive output tube. A bisection of the connecting bars is a plane of reflection symmetry. At this point the mode of interest, the symmetric mode, and hence its fields behave as if the symmetry plane were a magnetic wall. Again, although circuit 39 is shown to include a structure similar to the ring-bar structure 300 shown in FIG. 6, other structure, such as the contra-wound coil 200 shown in FIG. 5 can also be used to connect the first and second polepieces 24 and 41.

Having thus described preferred embodiments of an inductive output tube with an extended-interaction output circuit, it should be apparent to those skilled in the art that certain advantages of the described method and system have been achieved. It should also be appreciated that various modifications, adaptations, and alternative embodiments thereof may be made within the scope and spirit of the present invention.

What is claimed is:

1. An amplifying apparatus, comprising:

a broadband impedance transformer;

an electron gun including a cathode, an anode spaced a distance therefrom, and a grid disposed between said cathode and anode, said cathode providing an electron beam that passes through said grid and said anode, said grid being coupled to an input radio frequency (RF) signal via said broadband impedance transformer, said RF signal density modulating said electron beam;

a first polepiece comprising a first centered hole through which said electron beam passes;

a second polepiece comprising a second centered hole through which said electron beam passes;

a drift tube extended from and concentric with said electron gun and anode and surrounding said electron beam, said drift tube including a space defined between said first and second polepieces; and a collector extended from said second polepiece, said electron beam passing into said collector after transit across said space;

wherein said broadband impedance transformer comprises a transmission line having one or more sections, each of said one or more sections having approximately one-quarter of a RF wavelength in length, each of said one or more sections further having a respective characteristic impedance intermediate in magnitude between impedance levels existing at each end of each corresponding one of said one or more sections.

2. The amplifying apparatus of claim 1, wherein said collector comprises a plurality of electrode stages comprising a first electrode stage and a plurality of remainder electrode stages, said first electrode stage being connected electrically with said drift tube, said plurality of remainder electrode stages being insulated from each other and connected to a plurality of electrical potential sources having electrical potentials with magnitudes less than that of an electrical potential on said anode measured with respect to an electrical potential on said cathode.

3. The amplifying apparatus of claim 1, further comprising a magnetic solenoid located between said first and second polepieces and generating magnetic flux, said magnetic flux guiding said electron beam as it passes through said first and second polepieces, said space, and said extended-interaction output circuit.

4. An amplifying apparatus, comprising:

a broadband impedance transformer;

an electron gun including a cathode, an anode spaced a distance therefrom, and a grid disposed between said cathode and anode, said cathode providing an electron beam that passes through said grid and said anode, said grid being coupled to an input radio frequency (RF) signal via said broadband impedance transformer, said RF signal density modulating said electron beam;

a first polepiece comprising a first centered hole through which said electron beam passes;

a second polepiece comprising a second centered hole through which said electron beam passes;

a drift tube extended from and concentric with said electron gun and anode and surrounding said electron beam, said drift tube including a space defined between said first and second polepieces;

a collector extended from said second polepiece, said electron beam passing into said collector after transit across said space; and a gap defined between said grid and said cathode, wherein said broadband impedance transformer comprises a short length section of a transmission line connected directly to said gap, said short length section having a higher characteristic impedance than a corresponding impedance of said gap so that said short length section acts as a series inductance that cancels a shunt capacitance of said gap.

5. An amplifying apparatus, comprising:

a broadband impedance transformer;

an electron gun including a cathode, an anode spaced a distance therefrom, and a grid disposed between said cathode and anode, said cathode providing an electron beam that passes through said grid and said anode, said grid being coupled to an input radio frequency (RF) signal via said broadband impedance transformer, said RF signal density modulating said electron beam;

a first polepiece comprising a first centered hole through which said electron beam passes;

a second polepiece comprising a second centered hole through which said electron beam passes;

a drift tube extended from and concentric with said electron gun and anode and surrounding said electron beam, said drift tube including a space defined between said first and second polepieces;

a collector extended from said second polepiece, said electron beam passing into said collector after transit across said space; and a gap defined between said grid and said cathode, wherein said grid comprises a plurality of grid conductors and wherein said cathode comprises a plurality of regions between said plurality of grid conductors and a plurality of grooves located under said plurality of grid conductors to minimize a capacitance of said gap while maintaining a high level of electron emission from said plurality of regions between said plurality of grid conductors.

6. An amplifying apparatus, comprising:

a broadband impedance transformer;

an electron gun including a cathode, an anode spaced a distance therefrom, and a grid disposed between said cathode and anode, said cathode providing an electron beam that passes through said grid and said anode, said grid being coupled to an input radio frequency (RF) signal via said broadband impedance transformer, said RF signal density modulating said electron beam;

a first polepiece comprising a first centered hole through which said electron beam passes;

a second polepiece comprising a second centered hole through which said electron beam passes;

a drift tube extended from and concentric with said electron gun and anode and surrounding said electron beam, said drift tube including a space defined between said first and second polepieces;

a collector extended from said second polepiece, said electron beam passing into said collector after transit across said space; and a gap defined between said grid and said cathode, wherein said grid comprises a plurality of grid conductors, and wherein said cathode comprises a plurality of regions between said plurality of grid conductors and a plurality of depressions located under said plurality of grid conductors to minimize a capacitance of said gap while maintaining a high level of electron emission from said plurality of regions between said plurality of grid conductors.

7. An amplifying apparatus, comprising:

a broadband impedance transformer;

an electron gun including a cathode, an anode spaced a distance therefrom, and a grid disposed between said cathode and anode, said cathode providing an electron beam that passes through said grid and said anode, said grid being coupled to an input radio frequency (RF) signal via said broadband impedance transformer, said RF signal density modulating said electron beam;

a first polepiece comprising a first centered hole through which said electron beam passes;

a second polepiece comprising a second centered hole through which said electron beam passes;

a drift tube extended from and concentric with said electron gun and anode and surrounding said electron beam, said drift tube including a space defined between said first and second polepieces;

a collector extended from said second polepiece, said electron beam passing into said collector after transit across said space;

an extended-interaction output circuit located between said first polepiece and said second polepiece and within said space of said drift tube, said extended-interaction output circuit connecting said first polepiece with said second polepiece; and an output device connected with said extended-interaction output circuit, said density modulated beam passing through said extended-interaction output circuit and coupling an amplified RF signal into said output device.

8. The amplifying apparatus of claim 7, wherein said extended-interaction output circuit comprises a short-circuited resonant structure.

9. The amplifying apparatus of claim 7, wherein said extended-interaction output circuit reduces undesired components of an RF wave on said extended-interaction output circuit and increases useful electron beam interaction components of said RF wave.

10. The amplifying apparatus of claim 7, wherein said extended-interaction output circuit comprises first and second ends, wherein said first end is connected with said first polepiece, wherein said second end is connected with said second polepiece, and wherein said extended-interaction output circuit is short-circuited at said first and second ends.

11. The amplifying apparatus of claim 7, wherein said extended-interaction output circuit comprises a slow wave structure for slowing down RF wave propagation within said structure.

12. The amplifying apparatus of claim 11, wherein said slow wave structure comprises a clockwise conducting helix and a counter-clockwise conducting helix.

13. The amplifying apparatus of claim 11, wherein said slow wave structure comprises a plurality of aligned parallel rings and a plurality of alternating bars and wherein said plurality of aligned parallel rings are joined together on alternating sides by said plurality of alternating bars.

14. The amplifying apparatus of claim 7, wherein said extended-interaction output circuit comprises a single gap cavity, wherein said single gap cavity defines a shunt resistance and a quality factor, and wherein a ratio of said shunt resistance to said quality factor has a value greater than 200.

15. The amplifying apparatus of claim 7, wherein said extended-interaction output circuit comprises a beam tunnel extending through said extended-interaction output circuit, wherein said density modulated beam passes through said extended-interaction output circuit via said beam tunnel, and wherein said beam tunnel has a inner radius equivalent to one-half to one and one-half radian of transit angle at an operating frequency for an electron traveling at a velocity corresponding to a voltage of said density modulated beam.

16. The amplifying apparatus of claim 15, wherein said beam tunnel comprises a ring-bar structure having a plurality of rings and wherein said beam tunnel is provided by a hole within each of said plurality of rings.

17. The amplifying apparatus of claim 16, wherein said impedance transformer has a tapered pitch.

18. An amplifying apparatus, comprising:

a broadband impedance transformer;

an electron gun including a cathode, an anode spaced a distance therefrom, and a grid disposed between said cathode and anode, said cathode providing an electron beam that passes through said grid and said anode, said grid being coupled by said broadband impedance transformer to an input radio frequency (RF) signal that density modulates said electron beam;

a drift tube extended from and concentric with said electron gun and anode and surrounding said electron beam, said drift tube including a first portion and a second portion, a gap being defined between said first and second portions, said gap comprising an output circuit;

a first polepiece comprising a first centered hole through which said first drift tube portion passes;

a second polepiece comprising a second centered hole through which said second drift tube portion passes;

a magnetic solenoid located between said first polepiece and said second polepiece and generating magnetic flux, said magnetic flux guiding said electron beam as it passes through said first and second drift tube portions and said gap;

an output line connected with said output circuit, said density modulated beam passing through said output circuit and coupling an amplified RF signal into said output line; and a collector extended from said second drift tube portion and said second polepiece, said electron beam passing into said collector after transit across said gap;

wherein said cathode comprises an emitting surface for emitting said electron beam, wherein said grid comprises a plurality of closely spaced perforations opposing said emitting surface, and wherein said grid perforations are dimensioned to provide a higher current density near an axis of said electron beam for a given total current than would otherwise occur at a grid having perforations of uniform dimension.

19. The amplifying apparatus of claim 18, wherein said collector comprises a plurality of electrode stages comprising a first electrode stage and at least one remainder electrode stage, said first electrode stage being connected electrically with said second drift tube portion, said plurality of electrode stages being insulated from each other and connected to a plurality of electrical potential sources having electrical potentials less than that of an electrical potential on said anode, an electrical potential on said first drift tube portion, and an electrical potential on said second drift tube portion.

20. An amplifying apparatus, comprising:

a broadband impedance transformer;

an electron gun including a cathode, an anode spaced a distance therefrom, and a grid disposed between said cathode and anode, said cathode providing an electron beam that passes through said grid and said anode, said grid being coupled by means of said broadband impedance transformer to an input radio frequency (RF) signal that density modulates said electron beam;

a first polepiece comprising a first centered hole through which said electron beam passes;

a second polepiece comprising a second centered hole through which said electron beam passes;

a drift tube extended from and concentric with said electron gun and anode and surrounding said electron beam, said drift tube including a gap defined between said first and second polepieces;

an output circuit located between said first polepiece and said second polepiece and within said gap of said drift tube;

an output conductor connected with said output circuit, said density modulated beam passing through said output circuit and coupling an amplified RF signal into said output conductor; and a collector extended from said second polepiece, said electron beam passing into said collector after transit across said gap.

21. The amplifying apparatus of claim 20, wherein said output circuit comprises a short-circuited resonant structure.

22. The amplifying apparatus of claim 21, wherein said short-circuited resonant structure comprises a ring-bar structure.

23. The amplifying apparatus of claim 21, wherein said short-circuited resonant structure comprises at least two contra-wound helices.

24. The amplifying apparatus of claim 20, wherein said output circuit comprises extension means for providing larger RF bandwidth operation.

25. The amplifying apparatus of claim 24, wherein said extension means provide an RF bandwidth of not below four percent of an operating frequency of the amplifying apparatus.

26. The amplifying apparatus of claim 20, wherein output circuit comprises:

means for reducing undesired components of an RF wave;

means for increasing desired components of said RF wave; and means for slowing down a propagation of said RF wave.

* * * * *